US005884888A

United States Patent [19]

Grimes, III et al.

[11] Patent Number: 5,884,888

[45] Date of Patent: Mar. 23, 1999

[54] READING MATERIAL SUPPORT

[75] Inventors: Johnie Grimes, III, Mount Laurel; Hamilcar H. Candera; Timothy J. Sweeney, both of Mt. Laurel, all of N.J.

[73] Assignee: Faith Ventures, Mount Laurel, N.J.

[21] Appl. No.: 954,800

[22] Filed: Oct. 20, 1997

[51] Int. Cl.[6] ..... A47B 19/00

[52] U.S. Cl. ..... 248/441.1; 362/98

[58] Field of Search ..... 248/441.1, 445, 248/446, 447, 447.2, 443, 444, 448, 449, 450, 451, 452, 453, 188.2, 188.3, 188.4, 188.8; 362/98, 92, 99; D6/399

[56] References Cited

U.S. PATENT DOCUMENTS

| | | | |
|---|---|---|---|
| D. 99,414 | 4/1936 | O'Neill | D6/397 |
| D. 217,830 | 6/1970 | Heller | D26/51 |
| D. 296,629 | 7/1988 | Tong | D6/399 |
| D. 362,130 | 9/1995 | Alba | D6/399 |
| 794,099 | 7/1905 | Heaney | 248/442.2 |
| 1,347,645 | 7/1920 | Manny | 248/448 |
| 2,136,701 | 11/1938 | Manierre | 248/445 |
| 3,790,770 | 2/1974 | Stern | 240/2 P |
| 3,823,312 | 7/1974 | Weinstein | 240/6.4 B |
| 3,833,197 | 9/1974 | Dyke | 248/441 |
| 4,021,013 | 5/1977 | Wiersma | 248/453 |
| 4,118,759 | 10/1978 | Hauville | 362/98 |
| 4,162,055 | 7/1979 | Summers | 248/441 R |
| 4,191,354 | 3/1980 | CHia-Liu | 248/445 |
| 4,432,042 | 2/1984 | Zeller | 362/183 |
| 4,465,255 | 8/1984 | Hill | 248/441.1 |
| 4,591,124 | 5/1986 | Hellenbrand et al. | 248/447.2 |
| 4,596,392 | 6/1986 | Ford | 248/444.1 |
| 4,644,675 | 2/1987 | Berger et al. | 40/531 |
| 4,680,681 | 7/1987 | Fisherman et al. | 362/98 |
| 4,700,634 | 10/1987 | Mills et al. | 108/43 |
| 4,907,777 | 3/1990 | Stewart | 248/453 |
| 4,925,144 | 5/1990 | White | 248/445 |
| 5,025,353 | 6/1991 | Menaged | 362/98 |
| 5,161,766 | 11/1992 | Arima | 248/447 |
| 5,195,714 | 3/1993 | Stewart | 248/448 |
| 5,199,680 | 4/1993 | Rivera | 248/441.1 |
| 5,280,416 | 1/1994 | Hartley et al. | 362/98 |
| 5,442,528 | 8/1995 | Vandenbelt | 362/98 |
| 5,688,037 | 11/1997 | Chen | 362/98 |
| 5,695,271 | 12/1997 | Zeller | 362/98 |

*Primary Examiner*—Leslie A. Braun
*Assistant Examiner*—Tan Le
*Attorney, Agent, or Firm*—Roberts & Brownell, LLC

[57] ABSTRACT

A unique illuminated, flexible, portable reading material support apparatus permits the user to read more easily in certain situations, such as while sitting or lying in bed, due to the use of a special base, a goose-neck flexible support, and a swivel attachment means connecting the goose neck flexible support to a specially contoured reading support platform. The reading material support platform is comprised of a linear deep recess for receiving the binding (back) of a book or other reading material, top and bottom ledges, and left and right reading material page supports that vary in depth from that of the deep linear recess from whence they originate, to zero depth at the extreme left and right edges, respectively. This topography is designed to match the "natural" contours of opened reading material positioned upon the reading material support platform. In addition, two elastic bands placed about the reading material support platform function to hold pages of reading material flush against the reading material support platform, thereby permitting easier notating and highlighting of reading material. A reading lamp is attached to the top ledge, and is adjustable to permit optimal lighting. The special base is a light weight flat material in a generally rectangular shape, or is a clip or clamp to facilitate attachment to various surfaces.

20 Claims, 3 Drawing Sheets

READING MATERIAL SUPPORT

FIELD OF THE INVENTION

The present invention relates generally to an illuminated, flexible support apparatus for reading materials. In particular, the present invention relates to an illuminated, flexible reading material support apparatus with a unique topography for the reading material support surface, and a base (alternatively, a clamp or clip), flexible goose-neck support, and swivel whose combined functions permit the user to more easily position reading material for optimum comfort and ease of reading while in bed or in other situations.

BACKGROUND OF THE INVENTION

Supports for reading and other materials are well known. One of the most common types of supports is that for musical scores, as is seen in symphonies and music recitals being used by musicians. These supports include a floor stand with an adjustable, tiltable, flat music support with a bottom ledge to prevent the musical scores from slipping down. These supports also include fixed ledge and tilted, fixed-angle back supports as are found, for example, in pianos and organs. Another common support is the lectern or podium that lecturers and teachers use to hold, in a fixed orientation, their notes and other materials used in presentations.

The above supports are designed for specific, relatively limited applications. However, a variety of other kinds of supports for reading and other materials have been disclosed. For example, U.S. Pat. No. 3,790,770 to Stern discloses an illuminated reading material support designed to facilitate reading while seated or lying in bed. One embodiment features a cantilevered arrangement whereby legs with wheels may roll under a bed or chair, for example, and the orientation of the lighted book-holding support platform may be varied both by a rigid adjustable arm and an adjustable vertical support pole. Further, the positions of two sets of tubular lights, located on opposite sides of the material support platform, may be varied according to need. In another embodiment, the reading material support is a flat sheet of clear material that, along with the two sets of adjustable tubular lights, is attached by an adjustable rigid support to the head board of a bed. The user then places the reading material face down onto the clear reading material support, which permits the user to read from below, for example, while lying on his back.

U.S. Pat. No. 3,823,312 to Weinstein discloses an illuminated reading material support that features hinged leaves for supporting the pages and the cover of a book, bands to secure the back and front covers of a book, and a switch that turns the light on when the hinged leaves are opened. A spine comprises a holder for batteries, as well as attachment points for the hinges of the hinged leaves and for a support arm for the light. The position of the light is adjusted at a hinge in the support arm.

U.S. Pat. No. 4,021,013 to Wiersma discloses an illuminated book holding device comprising a support surface with a ledge and a means for attachment to the headboard of a bed. The ledge, against which the bottom of a book may rest, is attached to a lower edge of the support surface. Two mounting/support rods, which attach the support surface to a headboard, are swivelled to permit positioning of the support surface to the benefit of the user.

U.S. Pat. No. 4,118,759 to Hauville discloses an illuminated, hanging book support that maintains a book in a suspended position. Back, side and bottom members support a book placed in the book support. The bottom member is metallic, and two magnets may be attached thereto to hold the book's pages in place for easier reading. A lamp shade is featured, as is an adjustable (up/down) suspension member.

U.S. Pat. No. 4,162,055 to Summers discloses a copy-holding device that comprises a flat rectangular base, an upright pivotable support column, and a support platform for written material. The support platform has a lower ledge to support written material, and a magnet for securing written material to the platform and/or for holding written material flat against the platform. Interchangeable pivotable support columns may be used.

U.S. Pat. No. 4,465,255 to Hill discloses a book holder for use in bed. A planar base can be inserted between a mattress and box springs to anchor the lower ends of the pivotable support arms that attach to the base. A transparent platform is flexibly attached to the upper ends of the support arms. A clip/clamp holds a book or magazine in place, face down, so that it may be read by an individual lying in bed. A lighting fixture may be attached to the platform.

U.S. Pat. No. 4,591,124 to Hellenbrand, et al. discloses an illuminated book support for removable attachment to a hospital bed frame. A series of pivotable and slidable articulations, held in position by wing nut and bolt assemblies, permit adjustment for optimal reading position. The position of the lamp is also adjustable.

U.S. Pat. No. 4,907,777 to Stewart discloses an illuminated book support for reading while reclined. A pivotably mounted support assembly includes two ledges to support the bottom and one side of an open book. Pegs fit in holes in the ledges to hold the book and the book pages in place. A lamp is mounted in an open box base.

U.S. Pat. No. 5,195,714 to Stewart discloses a book support for attachment to a pole lamp. Adjustable ledges permit optimal positioning of a book or other reading material. Pegs may be placed in holes in the ledges to hold the book and its pages in proper position. A fan-shaped shade is attached to an adjustable arm to shade the reader's eyes from the light from the pole lamp.

U.S. Pat. No. 5,199,680 to Rivera discloses an illuminated, adjustable book holder. A cage-like structure holds a book, and a horizontal pair of rods secures the book and its pages in position for reading. The position of a light is fully adjustable upon a flexible goose-neck that forms a generally vertical support for the light.

U.S. design Pat. No. 296,629 to Tong discloses a design for an illuminated, foldable, easel-like book support. The support arm for the lamp is hinged at two joints. Slidable supports for the back of the book are featured at the top portion of the book support. A ledge at the bottom includes pegs for securing the front and the back of a book positioned on the ledge.

U.S. design Pat. No. 362,130 to Alba discloses a design for an illuminated, adjustable book support that also has a support for an adjustable snack tray. The vertical support column for the snack tray and book support is slidably extendable.

The above patented material supports all appear to function well within their mechanical limits. However, these supports do not disclose a means for facile movement of the support surface for the book, magazine, or other reading material. In addition, the above supports do not disclose a material support with a topography that closely matches the natural contours of a book or magazine thereon; without this type of support, mechanical strain on the reading material can lead to a shortened practical life.

Thus, an improvement over previous reading material supports would include a totally facile positioning means for the reading material support surface, implemented by incorporating such a mechanical means in a generally vertical support column. Another improvement over previous reading material supports would include a reading material support surface with more "natural" contours in the topography such that the support surface more closely matches the natural shape of the reading material, thereby putting less strain on the reading material and simultaneously adding more practical life to the reading material. In addition, such a latter feature would carry an added benefit of permitting easier writing and notating upon the reading source pages (owing to the pages being flush against the support surface), this being important, for example, for a student highlighting more important passages for later review and study. Such a feature also would benefit the individual who was writing a letter, composing music, etc.

SUMMARY OF THE INVENTION

It is an object of the present invention to provide a reading material support with a totally facile positioning means such that the user has virtually immediate and easy adjustment of the position and orientation of the support surface by simple movement of a highly flexible generally vertical support column, combined with a swivel attachment means between the support platform and the generally vertical support column.

It is another object of the present invention to provide a reading material support with a topography that provides a support surface that more closely matches the natural contours of common reading materials, such as books, booklets, and magazines, such that less strain is put on them, thereby resulting in longer practical lives for those reading materials.

It is a further object of the present invention to provide a reading material support with a topography that permits easier writing and notating on the reading material located thereon, due to the pages being more flush to the support surface.

It is yet another object of the present invention to provide a reading material support that may easily and quickly be used in a variety of situations, including those in which the user is in bed, in a chair, on a couch, etc., due to its relatively compact size and light weight construction, as well as to its base or, alternatively, to its surface attachment means, such as a clamp or clip.

The present invention accomplishes the above objectives by providing a unique reading material support that is light and easily portable, and that comprises:

1) A generally horizontally oriented base provides maximum stability, in view of the portability feature, including flexibility as to place of use by permitting it, for example, to be slid under a mattress or box springs, a seat cushion, a blanket, a seated user's legs, etc.; alternatively, a clamp or clip (or functional equivalent thereof) may be utilized for additional alternatives as to place of use of the invention.
2) A goose-neck flexible support arm attaches a reading support platform to
3) A generally vertically oriented pipe that in turn is attached to the base, with this component being optionally omitted in some embodiments;
4) The reading support platform is attached to the upper end of the goose-neck flexible support arm via a swivel;
5) A reading light is attached to the support platform;
6) The reading support platform forms a cradle for the reading material, including a topography that comprises a centrally located linear deep recess in which the binding (back) of a book or magazine may rest, and a gently tapering of the deep recess to zero depth toward the right and left edges corresponding to the right and left edges, respectively, of a book or magazine placed thereon;
7) Right and left portions (divided by the deep linear recess) of the reading support platform each include an elastic band that functions to retain relatively flat the pages of the reading material; and
8) Top and bottom ledges of the reading support platform both provide structural strength, and the top ledge also provides an attachment point for the reading light.

DESCRIPTION OF THE PREFERRED EMBODIMENTS

Figure 1:
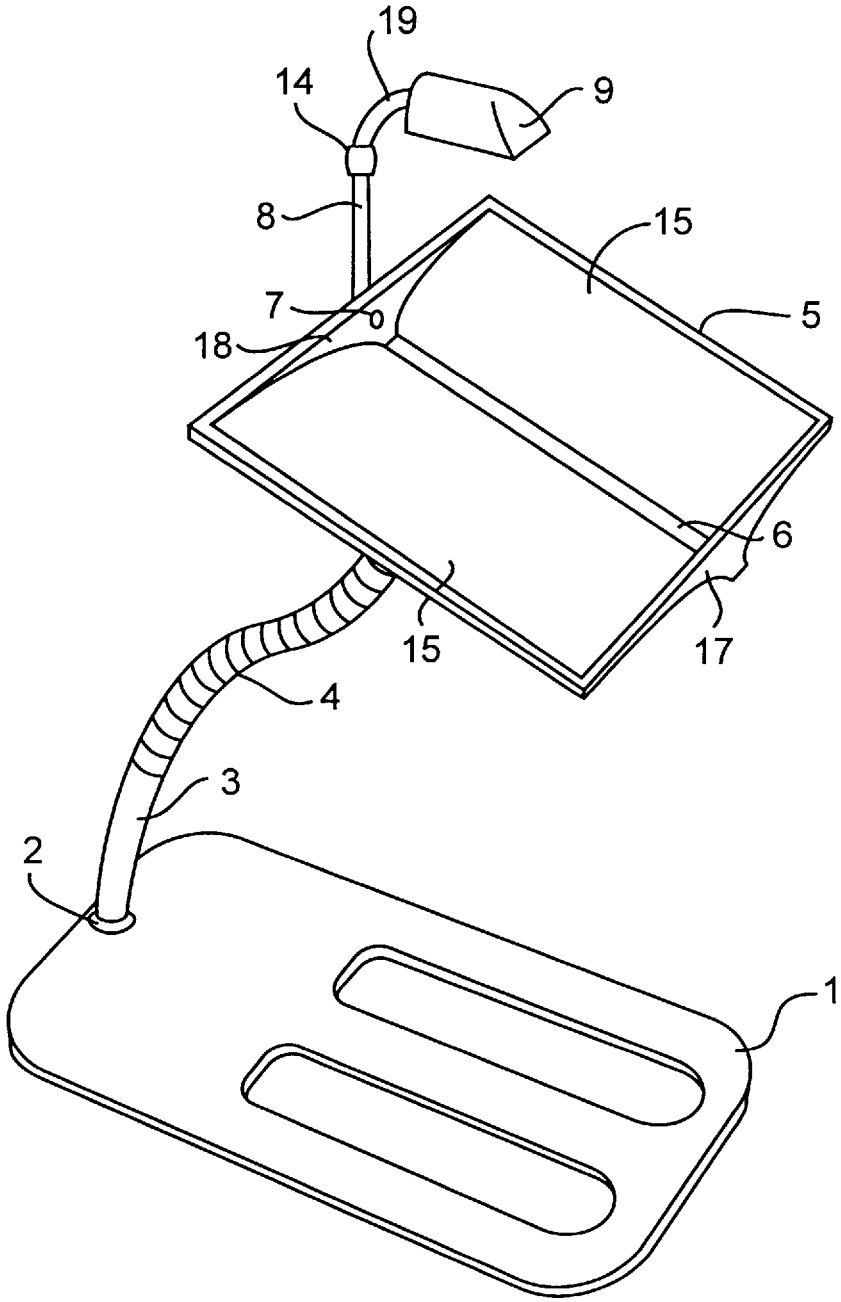
FIG. 1 shows a perspective view of the reading material support of the present invention.

Referring to FIG. 1, a perspective view of the reading material support of the present invention is shown. To the base 1 is attached a pipe 3 by attachment means 2. (Optionally, pipe 3 may be omitted; and, independently, base 1 may be replaced optionally by a clip, clamp, or other functional equivalent for attachment means to a support surface, such as the headboard of a bed, a shelf, etc.) The base may be constructed from any conventional material, such as wood, metal or a plastic. In a preferred embodiment, the base is made of a medium to relatively hard plastic, for example, polystyrene, or, alternatively, polyethylene, PVC plastic, or functional equivalent. Similarly, the pipe may be of wood, metal or plastic. In a preferred embodiment the pipe is constructed from metal or a relatively hard plastic. The means for attachment of the pipe to the base may be any conventional means, such as bolt, nut-and-bolt combination, glue, screw, annular nut, pressure fitting (with or without an annular nut), welding, etc., or the pipe may have external threads that screw into complementary threads in the base. A goose-neck support section 4 ("flexible intermediate support") connects the pipe with the reading material support platform 5. (In alternative embodiments without a pipe, a goose-neck support connects the base, clip, clamp or functional equivalent with the reading material support platform 5.) The goose-neck section may be made of coiled plastic or metal. In a preferred embodiment, the goose-neck section is made of coiled metal.

Figure 3:
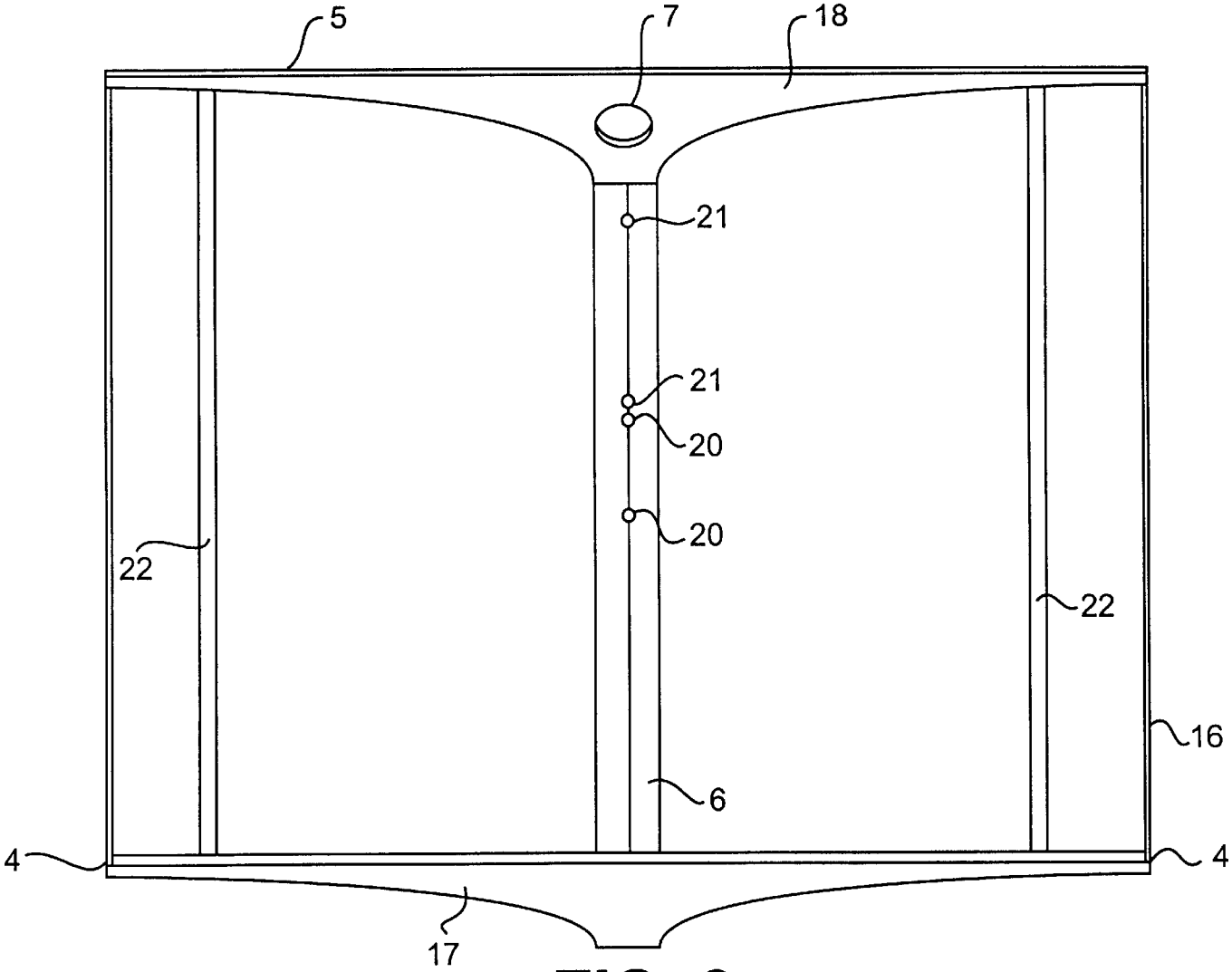
FIG. 3 shows a perspective view of the reading material support platform of the present invention.

The reading material support platform 5 comprises a deep linear recess 6, left and right reading material page supports 15, a bottom ledge 17, a top ledge 18, and an attachment point or hole 7 in the top ledge for attachment of a rigid, hollow support arm 8 for a lamp housing 9. The deep linear recess has a top side in which the spine or back of a book or magazine rests, and a bottom side to which the goose-neck support section attaches by a means incorporating a swivel (not shown). Referring to FIG. 3, holes 20 may be used to connect to a swivel by use of screws or bolts, for example; though other means clearly are within the scope of the present invention, including the use of glue, pressure fittings, snap fittings, welding, etc.

Returning to FIG. 1, the reading lamp is connected to the reading material support platform via an adjustable support arm comprising the rigid, hollow support arm, a flexion means 14 (for example, a swivel or ball-and-joint or functional equivalent), and a curved rigid or flexible/adjustable, hollow support arm 19. The rigid and flexible support arms may be of any conventional hollow material, for example wood, plastic or metal, and also may comprise a flexible goose-neck support. Welding also may be employed. In a preferred embodiment, the support arms are made of plastic. The reading lamp also comprises a fluorescent or incandescent bulb (not shown). In a preferred embodiment, the reading lamp is a Mighty Bright™ readers light, available from Goldcrest, Inc., Santa Barbara, Calif.

Figure 2:
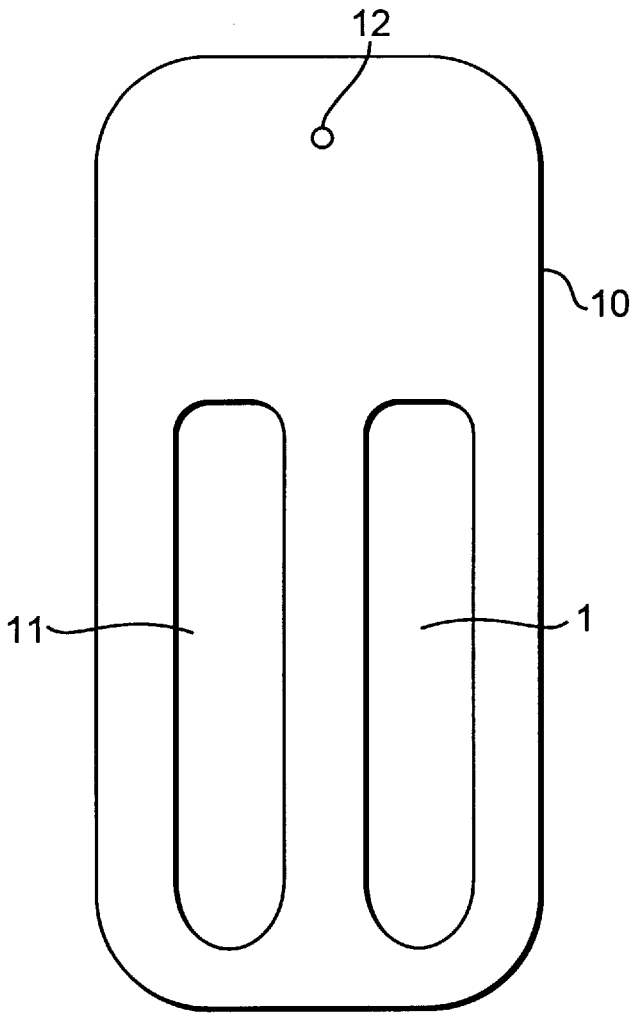
FIG. 2 shows a plan view of the base of the reading material support of the present invention.

Referring to FIG. 2, a plan view of the base 10 is shown. In a preferred embodiment, cutouts 11 help reduce the weight. Optional hole 12 provides for attachment of the base to the pipe 3, for example, by screw, bolt, pressure fitting insert, pressure snap fitting insert, etc.

Referring to FIG. 3, a perspective view of the reading support platform 5 is shown in detail. The deep linear recess 6 is shown to have two sets of holes. Optional two holes 20 may be used to attach the pivot (not shown) that is located under the deep linear recess and at the upper end of the goose-neck support 4. Optional two holes 21 may be use to attach a battery holder (not shown) to the underside of the deep linear recess. Screws and bolts, pressure fitting elements (made of plastic, wood, or metal), or pressure snap fitting elements may be used to secure the applicable structure to the underside of the deep linear recess. In a preferred embodiment, screws or bolts (not shown) are utilized. The screws or bolts may be of plastic or metal. Upper 18 and lower 17 ledges are shown, as are the left and right reading material page supports 15. Hole 7 in the upper ledge is the attachment point or hole for the rigid, hollow support arm for the reading lamp. Wires (not shown) from the battery holder pass through the hollow support arms to the bulb holding means of the reading lamp. Elastic bands 22 hold pages of reading material flush against the respective left and right reading material page supports. The elastic bands simply encircle the reading material support, and may be positioned anywhere along the breadth of the reading material page supports. The elastic bands may be made of rubber (i.e., rubber bands) or of other elastic material such as is used in clothing. The reading support platform is preferably made of plastic as one integral unit produced, for example, by vacuum molding. Polystyrene provides a suitable material for producing the reading support platform by vacuum forming; however, other functionally equivalent materials are also acceptable, including various PVC plastics and other plastics. Optionally, wood or metal embodiments are also possible.

Figure 4:
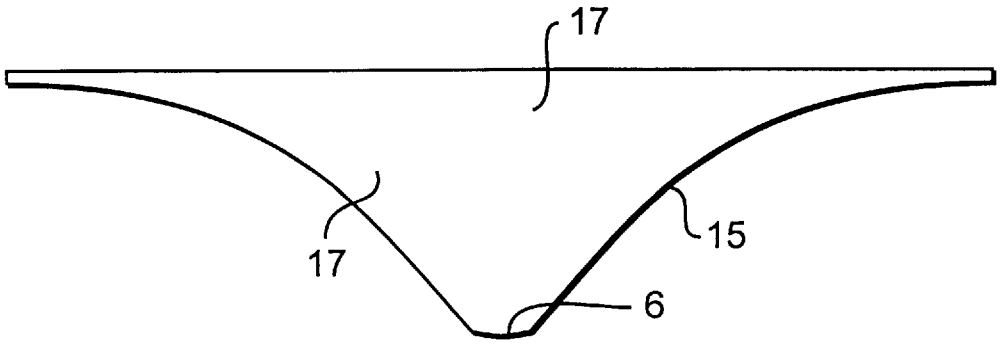
FIG. 4 shows a sectional view through line 4—4 of FIG. 3.

Referring to FIG. 4, a sectional view along line 4—4 of FIG. 3 (shape of the bottom ledge) is shown. Thus, the curving contours of the left and right reading material page supports are shown in relation to the deep linear recess of the reading material support platform, and show the gentle taper from maximum depth of the support platform at the deep linear recess, to zero depth at the respective left and right edges of the left and right reading material page supports.

The apparatus of the present invention has been presented in detail for the purpose of illustration. However, it is to be understood that variations can be made by those skilled in the art without departing from the spirit of scope of the present invention. For example, the skilled artisan will readily appreciate that other embodiments are possible, such as different shapes and sizes of the base and of the reading material support platform, utilization of a goose neck support as the sole support between the base and the reading material support platform, different plastics and other materials, etc. The apparatus of the present invention is defined by the following claims.

We claim:

1. A portable illuminated reading material support apparatus, comprising:

a flat and substantially rectangular shaped base with first and second ends and top and bottom sides;

a flexible support, comprising:

a pipe support with first and second ends, wherein the first end is attached to the top side of the first end of the base; and a flexible intermediate support with first and second ends, wherein the first end is attached to the second end of the pipe support; and a substantially rectangular reading material support platform, comprising:

a topside;

a bottomside;

a substantially rectangular linear recess for supporting a book binding, comprising a topside, a bottomside, a plurality of holes therethrough, a right side, a left side, an upper end, and a lower end, wherein the bottomside is attached to the second end of the flexible goose-neck support;

left and right reading material page supports, each comprising an upper end, a lower end, a right side and a left side, wherein the right side of the left reading material page support is attached to the left side of the linear recess, and the left side of the right reading material page support is attached to the right side of the linear recess; and upper and lower ledges, each comprising an upper end and a lower end, wherein:

the lower end of the upper ledge is attached to:

the upper end of the deep linear recess; and the upper ends of the left and right reading material page supports; and the lower end of the lower ledge is attached to:

the lower end of the linear recess; and the lower ends of the left and right reading material page supports.

2. The portable illuminated reading material support apparatus according to claim 1, wherein the base is made of plastic, wood, or metal.

3. The portable illuminated reading material support apparatus according to claim 2, wherein the base is made of plastic.

4. The portable illuminated reading material support apparatus according to claim 3, wherein the plastic is polystyrene, PVC plastic, or polyethylene.

5. The portable illuminated reading material support apparatus according to claim 1, wherein the pipe support is made of plastic, wood, or metal.

6. The portable illuminated reading material support apparatus according to claim 1, wherein the flexible intermediate support is a goose-neck support made of plastic or metal.

7. The portable illuminated reading material support apparatus according to claim 6, wherein the goose-neck support is made of metal.

8. The portable illuminated reading material support apparatus according to claim 1, wherein the reading material support surface is made of wood, plastic, or metal.

9. The portable illuminated reading material support apparatus according to claim 8, wherein the reading material support surface is made of plastic.

10. The portable illuminated reading material support apparatus according to claim 9, wherein the plastic is a molded plastic.

11. The portable illuminated reading material support apparatus according to claim 10, wherein the molded plastic is a vacuum formed molded plastic.

12. The portable illuminated reading material support apparatus according to claim 1, wherein the base further comprises at least one elongated hole for the purpose of lightening the base.

13. The portable illuminated reading material support apparatus according to claim 1, wherein the reading material support platform further comprises at least one elastic band encircling each reading material page support for the purpose of holding pages of reading material flush against the reading material support platform.

14. The portable illuminated reading material support apparatus according to claim 1, wherein the first end of the pipe support is attached to the top side of the first end of the base by an attachment means selected from the group consisting of:

glue;

at least one screw;

at least one bolt;

external threads at the first end of the pipe that engage complementary threads in the hole through the first end of the base;

welding; and pressure fitting of the first end of the pipe into the hole through the first end of the base.

15. The portable illuminated reading material support apparatus according to claim 1, wherein the bottomside of the linear recess is attached to the second end of a swivel means by an attachment means comprising:

at least two screws that engage holes through the deep linear recess;

at least two bolts that engage holes through the deep linear recess;

glue; or welding.

16. The portable illuminated reading material support apparatus according to claim 1, wherein a battery holder is attached to the bottomside of the upper end of the deep linear recess.

17. The portable illuminated reading material support apparatus according to claim 1, wherein the flexible support consists of a flexible goose-neck support.

18. A portable illuminated reading material support apparatus, comprising:

a flat base with a top side;

a pipe support with first and second ends, wherein the first end is attached to the top side of the base;

a flexible intermediate support with first and second ends, wherein the first end is attached to the second end of the pipe support;

a swivel means with first and second ends, wherein the first end is attached to the second end of the flexible intermediate support;

a roughly rectangular reading material support platform, comprising:

a topside;

a bottomside;

a substantially rectangular linear recess with a bottomside, an upper end, a lower end, a left side and a right side;

left and right reading material page supports, each with an upper end, a lower end, a right side and a left side, wherein:

the left side of the right reading material page support is attached to the right side of the linear recess, and the right side of the left reading material page support is attached to the left side of the linear recess; and upper and lower ledges, wherein:

the upper ledge is attached to:

the upper end of the linear recess, and the upper ends of the left and right reading material page supports; and the lower ledge is attached to:

the lower end of the linear recess, and the lower ends of the left and right reading material page supports; and a reading lamp with a flexible hollow arm, wherein the flexible hollow arm is attached to the upper ledge.

19. A portable illuminated reading material support apparatus, comprising: a base with a topside;

a flexible support comprising:

a flexible goose-neck support with first and second ends, wherein the first end is attached to the topside of the base;

a substantially rectangular reading material support platform, comprising:

a topside;

a bottomside;

a linear recess for supporting a book binding with a bottomside, an upper end, a lower end, a right side and a left side;

left and right reading material page supports, each with an upper end, a lower end, a right side and a left side, wherein:

the left side of the right reading material page support is attached to the right side of the linear recess, and the right side of the left reading material page support is attached to the left side of the linear recess; and upper and lower ledges, wherein:

the upper ledge is attached to:

the upper end of the linear recess, and the upper ends of the left and right reading material page supports; and the lower ledge is attached to:

the lower end of the linear recess, and the lower ends of the left and right reading material page supports;

and a reading lamp with a flexible hollow arm, wherein the flexible hollow arm is attached to the upper ledge.

20. A portable illuminated reading material support apparatus, comprising:

an attachment means with a top side, comprising a clip or a clamp;

a pipe support with first and second ends, wherein the first end is attached to the top side of the attachment means;

a flexible goose-neck support with first and second ends, wherein the first end is attached to the second end of the pipe support;

a swivel means with first and second ends, wherein the first end is attached to the second end of the flexible goose neck support;

a roughly rectangular reading material support platform, comprising:

a topside;

a bottomside;

a substantially rectangular linear recess with a bottomside, an upper end, a lower end, a left side and a right side;

left and right reading material page supports, each with an upper end, a lower end, a right side and a left side, wherein:

the left side of the right reading material page support is attached to the right side of the linear recess, and the right side of the left reading material page support is attached to the left side of the linear recess; and upper and lower ledges, wherein:

the upper ledge is attached to:

the upper end of the linear recess, and the upper ends of the left and right reading material page supports; and the lower ledge is attached to:

the lower end of the linear recess, and the lower ends of the left and right reading material page supports; and a reading lamp with a flexible hollow arm, wherein the flexible hollow arm is attached to the upper ledge.

* * * * *